US006584791B2

(12) United States Patent
Monk et al.

(10) Patent No.: US 6,584,791 B2
(45) Date of Patent: Jul. 1, 2003

(54) PRESSURE EQUALIZATION SYSTEM AND METHOD

(75) Inventors: David T. Monk, Bristol, VA (US); Larry G. Pippin, Bristol, VA (US); Pantelis V. Hatzikazakis, Kingsport, TN (US); William Z. Sun, Arkadelphia, AR (US); Timothy M. Wampler, Bluff City, TN (US); Charles E. Zimmerman, Bristol, TN (US)

(73) Assignee: Bristol Compressors, Inc., Bristol, VA (US)

( * ) Notice: Subject to any disclaimer, the term of this patent is extended or adjusted under 35 U.S.C. 154(b) by 0 days.

(21) Appl. No.: 09/826,106

(22) Filed: Apr. 5, 2001

(65) Prior Publication Data

US 2002/0144511 A1 Oct. 10, 2002

(51) Int. Cl.[7] ..... F25B 41/00; F25B 49/00; F25B 1/00; F25B 1/10; F04B 49/00

(52) U.S. Cl. ..... 62/196.3; 62/228.5; 62/510; 417/299; 417/435; 417/440; 418/201.2

(58) Field of Search ..... 62/196.3, 228.5, 62/510; 417/299, 435, 440; 418/201.2

(56) References Cited

U.S. PATENT DOCUMENTS

| | | | | | |
|---|---|---|---|---|---|
| 3,601,506 | A | | 8/1971 | Griswold | |
| 3,698,839 | A | * | 10/1972 | Distefano | 166/250.07 |
| 4,026,122 | A | * | 5/1977 | Kuhn et al. | 137/517 |
| 4,270,885 | A | * | 6/1981 | Shaffer et al. | 417/279 |
| 4,298,314 | A | * | 11/1981 | Thayer | 417/299 |
| 4,373,870 | A | * | 2/1983 | Pandzik | 417/269 |
| 4,382,370 | A | | 5/1983 | Suefuji et al. | |
| 4,470,428 | A | * | 9/1984 | Bishop et al. | 137/115.15 |
| 4,593,535 | A | * | 6/1986 | Ikeda et al. | 62/217 |
| 4,830,582 | A | * | 5/1989 | Asami et al. | 417/312 |
| 5,141,420 | A | * | 8/1992 | Nambiar | 137/220 |
| 5,395,214 | A | * | 3/1995 | Kawahara et al. | 417/53 |
| 5,651,267 | A | * | 7/1997 | Todescat et al. | 62/498 |
| 5,832,737 | A | * | 11/1998 | Moilanen | 417/310 |
| 5,911,562 | A | * | 6/1999 | Murphy et al. | 137/517 |
| 6,293,117 | B1 | * | 9/2001 | Ban et al. | 62/228.3 |
| 6,299,423 | B1 | * | 10/2001 | Perevozchikov | 137/855 |

FOREIGN PATENT DOCUMENTS

| | | |
|---|---|---|
| DD | 241 454 A1 | 12/1986 |
| EP | 0 743 456 A2 | 11/1996 |
| JP | 2001349627 | 12/2001 |
| WO | WO 94/21919 | 9/1994 |

* cited by examiner

*Primary Examiner*—William C. Doerrler
*Assistant Examiner*—Filip Zec
(74) *Attorney, Agent, or Firm*—McNees Wallace & Nurick, LLC

(57) ABSTRACT

A pressure equalization method and system is provided for starting a compressor while maintaining the compressor at a high pressure and comprises a valve and a bleed port. The compressor has a compressor inlet for receiving a fluid at a first pressure and a compressor outlet for discharging the fluid at a second pressure, and is operable to compress the fluid from the first pressure to the second pressure. The valve is proximate to and in fluid communication with the compressor outlet and is movable to an open position when the compressor is operating to allow the fluid at the second pressure to flow through the valve and is movable to a closed position when the compressor stops operating to prevent backflow of the fluid at the second pressure through the valve toward the compressor inlet. The bleed port is upstream of the valve and in fluid communication with the compressor inlet to equalize the pressure of the fluid contained in the compressor when the compressor stops operating.

15 Claims, 10 Drawing Sheets

PRESSURE EQUALIZATION SYSTEM AND METHOD

BACKGROUND OF THE INVENTION

The present invention relates generally to compressors, including those used in refrigeration and HVAC applications. More particularly, the present invention relates to a pressure equalization system and method for starting a compressor, such as a scroll, rotary, or reciprocating compressor, while maintaining the condenser at high pressure.

A standard refrigeration or HVAC system includes a fluid, an evaporator, a compressor, a condenser, and an expansion valve. In a typical refrigeration cycle, the fluid begins in a liquid state under low pressure. The evaporator evaporates the low pressure liquid, which lowers the ambient temperature, and the liquid becomes a low pressure vapor. The compressor draws the vapor in and compresses it, producing a high pressure vapor. The compressor then passes the high pressure vapor to the condenser. The condenser condenses the high pressure vapor, generating a high pressure liquid. The cycle is completed when the expansion valve expands the high pressure liquid, resulting in a low pressure liquid. By means of example only, the fluid might be ammonia, ethyl chloride, Freon, or other known refrigerants.

Typically, upon start up of a compressor, the pressure at both the suction and the discharge of the compressor is low. In operation, the compressor works the fluid to achieve a high pressure at the discharge. However, when the compressor is no longer compressing fluid, the fluid on the high pressure side of the compressor (toward the condenser) flows back toward or to the low side of the compressor (toward the evaporator) until a state of equilibrium between the formerly high and formerly low pressure sides is achieved. Thus, the high pressure side equalizes with the low pressure side when the compressor stops operating. Such a system is inefficient because the refrigeration cycle requires energy at start up to create a high pressure in the condenser, which is needed to condense the fluid.

Another problem, specific to HVAC systems, is that it is difficult to efficiently achieve the high pressure start up necessitated by seasonal energy efficiency requirements (SEER), a system used to rate HVAC systems. Start up components, such as a start capacitor and a start relay, are commonly used to overcome the differential pressure when the compressor needs to start with the unbalanced pressure in the system. These components achieve a high pressure differential start when the system is turned on. These components are rather expensive, however, and they produce high voltages and currents in the compressor motor upon start up.

In light of the foregoing, there is a need for an improved system and method for equalizing the pressure for starting a compressor under high pressure loading.

SUMMARY OF THE INVENTION

Accordingly, the present invention is directed to an improved system and a method for starting a compressor while maintaining the compressor at a high pressure.

As explained in more detail below, the system and method of the present invention maintain a high pressure from a valve forward to a condenser, but allow the pressure below the valve to leak back toward the compressor suction until the pressure below the valve has equalized with the low pressure side of the compressor. By high loading the pressure above the valve and equalizing the pressure below the valve, expensive and potentially dangerous start up components are eliminated. A benefit specific to HVAC systems is that the SEER rating of the system is not sacrificed.

Additional objects and advantages of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a pressure equalization system for a compressor. The compressor has a compressor inlet for receiving a fluid at a first pressure from the evaporator and a compressor outlet for discharging the fluid at a second pressure to the condenser. The compressor is operable to compress the fluid from the first pressure to the second pressure. The system of the present invention includes a valve proximate to and in fluid communication with the compressor outlet and a bleed port upstream of the valve and in relatively low flow fluid communication with the compressor inlet. The valve has an open and a closed position. The valve is movable to the open position when the compressor is operating, to allow the fluid at the second pressure to flow through the valve. The valve is movable to the closed position when the compressor stops operating, to prevent backflow of the fluid at the second pressure through the valve toward the compressor inlet. The bleed port equalizes the pressure of the fluid contained in the compressor when the compressor stops operating.

In another aspect, the invention is directed to a pressure equalization system for a compressor having a high pressure side and a low pressure side, a compressor inlet for receiving a fluid at a first pressure, and a compressor outlet for discharging the fluid at a second pressure. The compressor is operable to compress the fluid from the first pressure to the second pressure. The system in this embodiment includes a container in fluid communication with the compressor, at least one valve operably disposed within the container, and a bleed port. The container has an inlet and an outlet, and either the inlet or the outlet of the container is connected to the outlet of the compressor. The container is divided into at least a first portion from the container inlet to the at least one valve and a second portion from the at least one valve to the container outlet. The valve is operably configured to allow the compressed fluid to flow through to the second portion of the container when the compressor is operating, and to prevent the compressed fluid in the second portion of the container from flowing back through the valve to the first portion of the container when the compressor stops operating. The bleed port connects the first portion of the container and the low pressure side of the compressor and is operably configured to bleed the compressed fluid from the first portion of the container to the low pressure side of the compressor when the compressor stops operating. The bleed port is further configured so that when the compressor is operating, the flow through the bleed port is relatively low, if not nonexistent. As a result, a negligible amount of fluid flows back to the compressor inlet when the compressor is operating.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention. Together with the description, these drawings serve to explain the principles of the invention. In the drawings.

FIG. 5 is a cross-sectional view of a pressure equalization system, including a housing, two valves, and a bleed port, in accordance with another embodiment of the present invention.

DETAILED DESCRIPTION

Reference will now be made in detail to embodiments of the present invention, examples of which are illustrated in the accompanying drawings. Wherever possible, the same reference numbers will be used throughout the drawings to refer to the same or like parts.

In accordance with the present invention, a method and a system for equalizing the pressure in a compressor is provided to allow for startup of the compressor while maintaining the compressor at a high pressure. It is contemplated that the compressor may be a component of a climate control system, including a refrigeration, freezer, or HVAC system. However, its use is not limited to such systems as the pressure equalization system may be used in any system utilizing a compressor.

Figure 1:
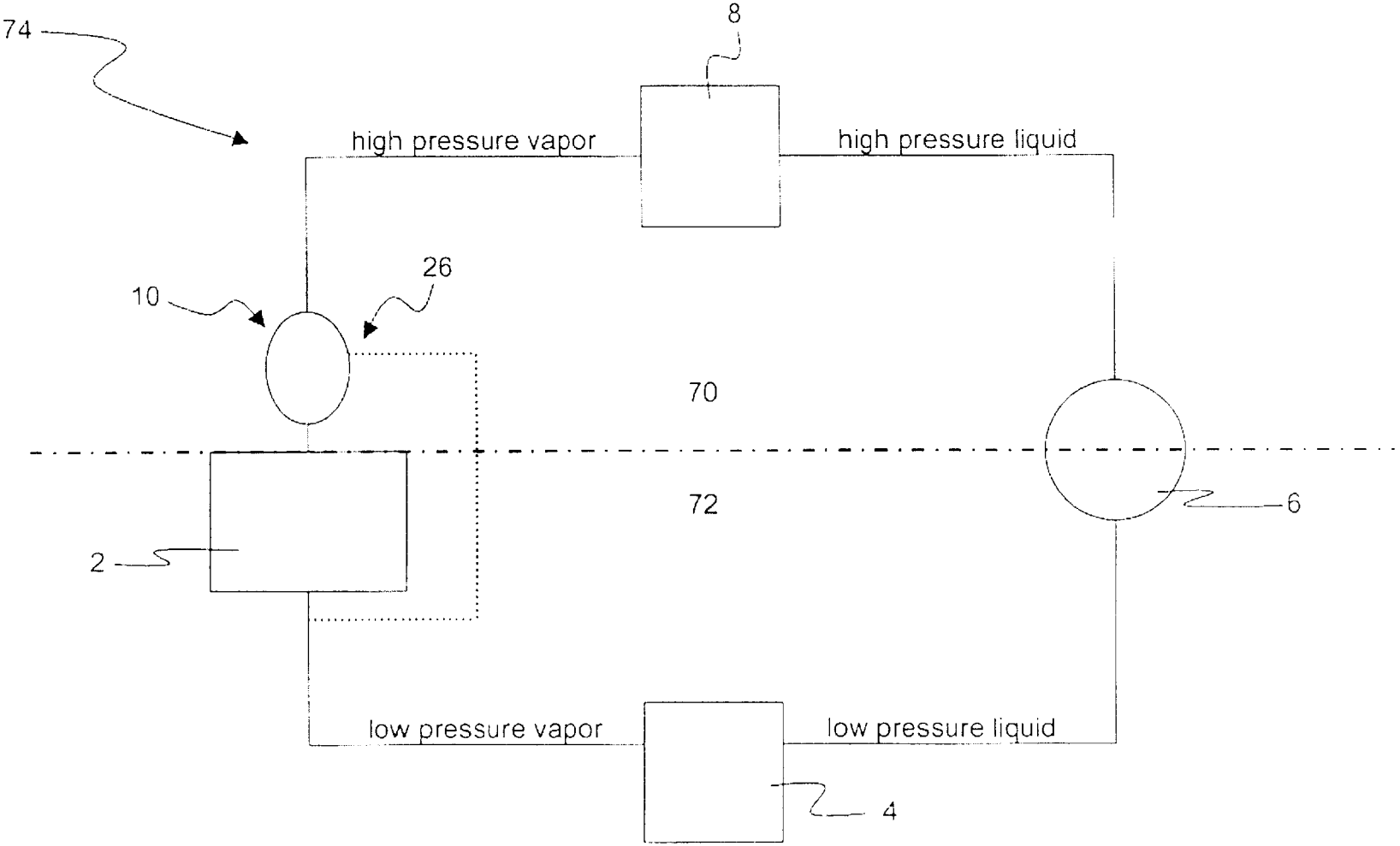
FIG. 1 is a block diagram of a climate control system schematically illustrating a pressure equalization system and method in accordance with the present invention.

An exemplary embodiment of a refrigeration system, including a compressor with a pressure equalization system according to the present invention, is illustrated in FIG. 1 and is designated generally as reference number 74.

In a refrigeration or HVAC system, typically a fluid or refrigerant flows through the system and heat is transferred from and to the fluid. When refrigeration system 74 is turned on, fluid in a liquid state under low pressure is evaporated in an evaporator 4, which lowers the ambient temperature and results in fluid in a low pressure vapor state. A compressor 2 draws away fluid at a low pressure vapor state and compresses it. Then, fluid at a high pressure vapor state flows to a condenser 8. Condenser 8 condenses the fluid from a high pressure vapor state to a high pressure liquid state. The cycle is completed when an expansion valve 6 expands the fluid from a high pressure liquid state to a low pressure liquid state. The result is a high side 70 and a low side 72 of the compressor. The fluid is any available refrigerant, such as, for example, ammonia, ethyl chloride, Freon, chlorofluocarbons, hydrofluorocarbons, and natural refrigerants.

In conventional systems, when refrigeration system 74 stops operating, the fluid on the high side of compressor 2 at a high pressure vapor state will leak back toward the evaporator 4, and eventually the pressure of the fluid in the compressor will reach a state of equilibrium. When the refrigeration system is placed back into operation, the pressure at the condenser must be brought back up to the pressures prior to refrigeration system 74 shutting down. In high efficiency systems, start capacitors and start relays are used to restart the compressor and achieve this result in when the pressures are not equal. These components are expensive and produce high voltages and currents in the compressor upon start up. Pressure equalization system 10 overcomes the need for such components in high efficiency systems and the problems and expenses associated with conventional systems, as described in more detail through the embodiments of the present invention.

Figure 2:
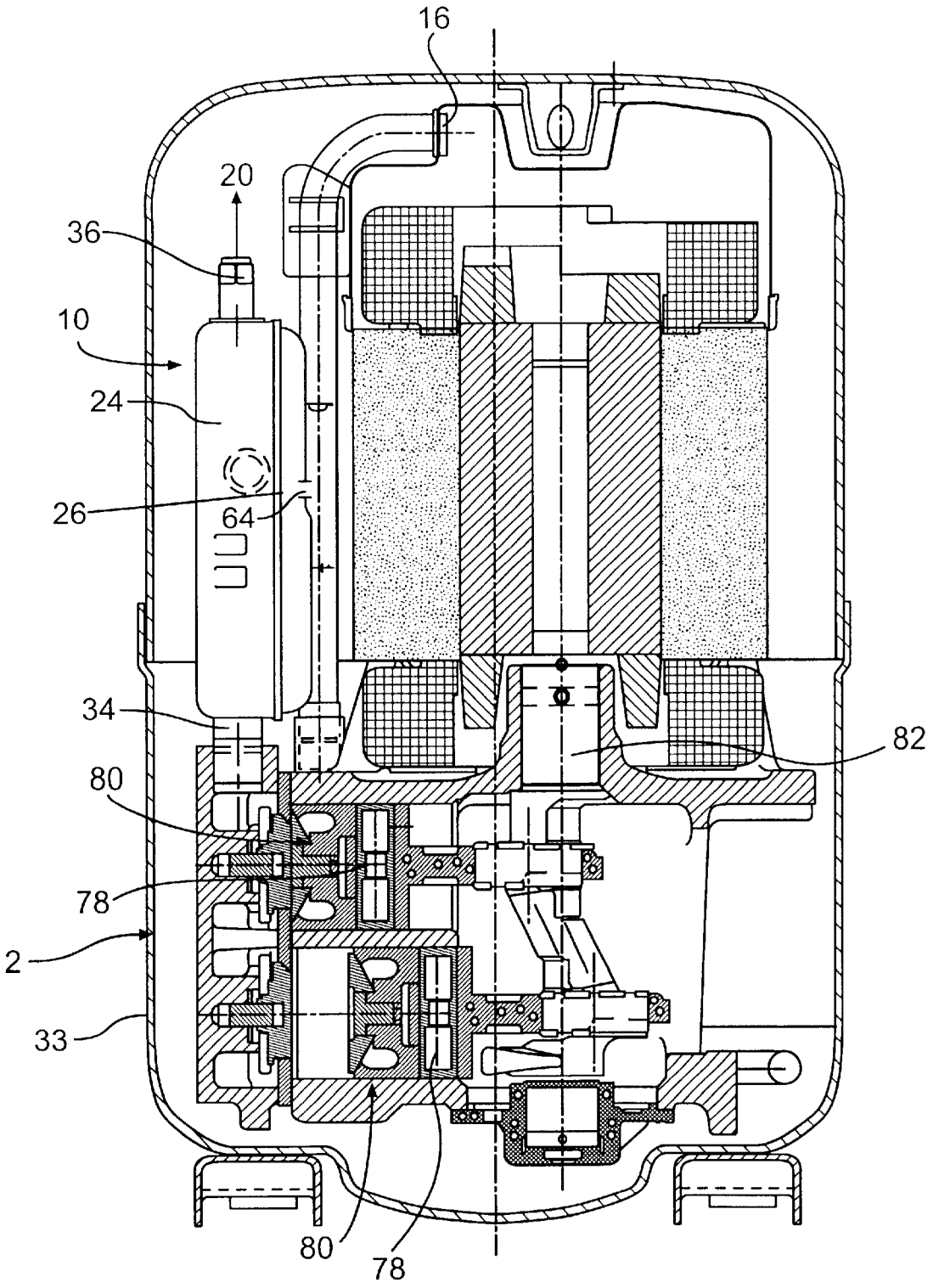
FIG. 2 is a cross-sectional view of a compressor including an internal pressure equalization system in accordance with an embodiment of the present invention.
Figure 3:
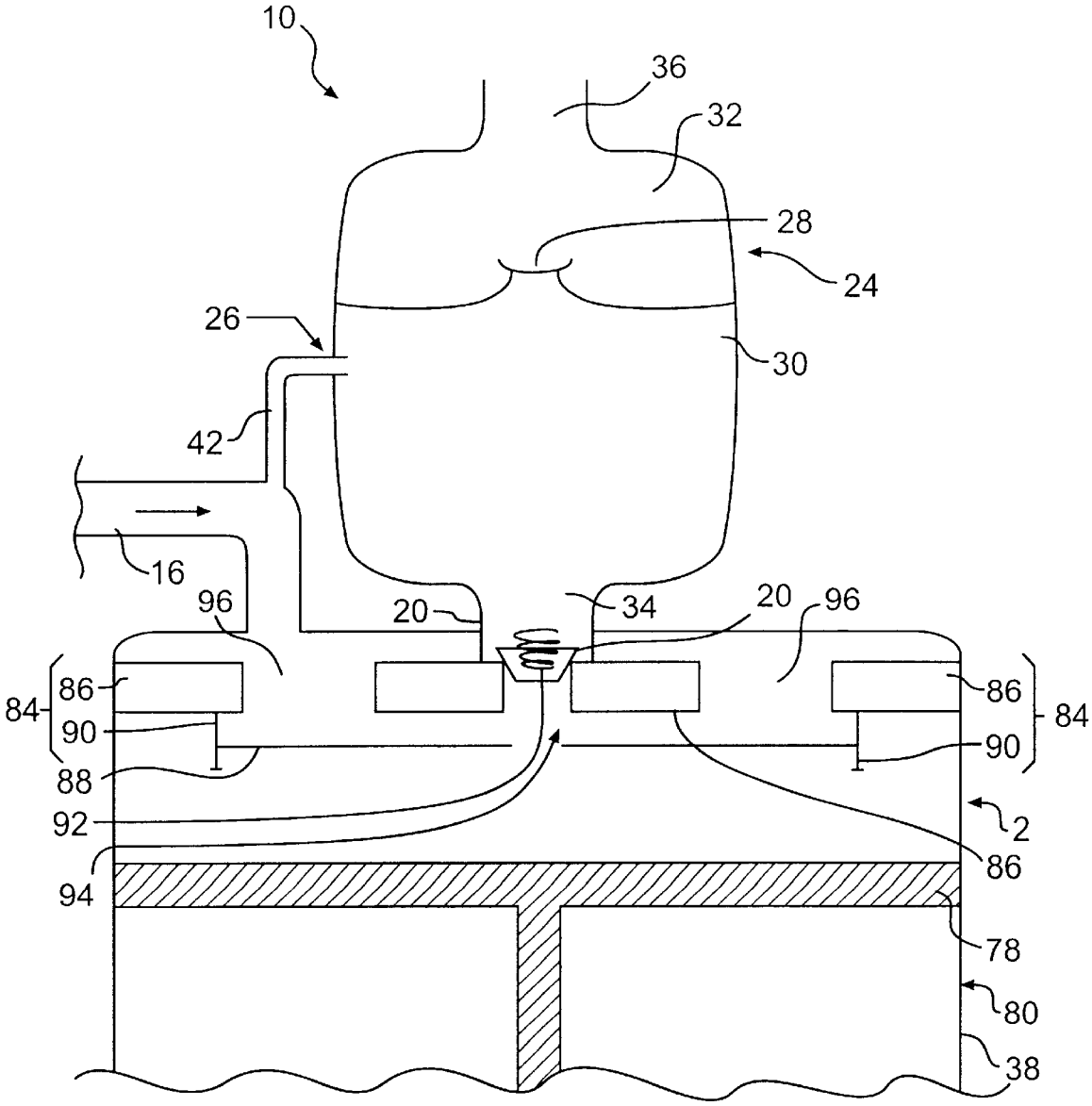
FIG. 3 is a cross-sectional view of a pressure equalization system attached externally to a compressor in accordance with another embodiment of the present invention.

The general components of a reciprocating compressor 2 are illustrated in FIGS. 2 and 3. The components may include compressor housing 38 that houses a shaft 82 that rotates and causes one or more pistons 78 to move within one or more compression chambers 80. The fluid, described above with respect to the schematic in FIG. 1, is drawn at a low pressure into a compressor inlet 16 (or suction line) and into compression chamber 80. For the purposes of the present invention, the compressor inlet 16 can be any point in the fluid flow channel extending from the evaporator 4 to the compression chambers 80. Piston 78 is operable to move within compression chamber 80 to compress the fluid, which exits compressor 2 at a high pressure through a compressor outlet 20 (or discharge). For the purposes of the present invention, the compressor outlet can be any point in the fluid flow channel from above the compression chamber 80 to the condenser 8.

As it is known, a compressor typically includes a valve system 84, such as the system exemplified in FIG. 3, to prevent the fluid from flowing back toward compressor inlet 16 when the compressor is operating. Such systems are known to those skilled in the art, and the system depicted in FIG. 3 is illustrative only and in no way limits the claimed invention. The illustrated valve system includes a valve plate 86 disposed within compressor housing 38, a valve 92 operably disposed at the compressor outlet 20, and a ring valve 88, defining an aperture 94, slidably disposed on holders 90. Retraction of piston 78 creates a vacuum that draws ring valve 88 away from gaps 96, and draws the fluid into compression chamber 80 through compressor inlet 16. A valve 92 on compressor outlet 20 prevents the fluid from exiting compressor 2 until the fluid reaches a pressure exceeding that beyond valve 92. When piston 78 moves and compresses the fluid to this pressure, the force of the fluid opens valve 92, thereby allowing the high pressure fluid to discharge through compressor outlet 20. During the compression stroke, the force of the fluid moves ring valve 88 towards valve plate 86, blocking gaps 96 and preventing the fluid from escaping through compressor inlet 16.

In accordance with the present invention, a pressure equalization system and method is provided to equalize the pressure in a system, such as a refrigeration system, allowing the compressor to start under high pressure loading. In one embodiment, the pressure equalization system is connected to the compressor and has a valve or a series of valves and a bleed port. The valve or valves maintain high pressure on the high pressure side of the compressor (from the valve to the condenser to the expansion valve) when the refrigeration system stops operating, while the bleed port allows the pressure in the compressor to reach a state of equilibrium with the low side of the compressor (from the expansion valve to the evaporator to the valve) when the refrigeration system is turned off. The bleed port is configured to allow little to no fluid to pass through when the system is operating but to allow fluid to leak through when the system is turned off. The pressure equalization system maintains fluid at a high pressure vapor state on the high pressure side (discharge) while allowing fluid on the low pressure side (suction) to reach a state of equilibrium with fluid at a low pressure vapor state. The high pressure side of the compressor remains high, as the evaporator serves as a check valve when the compressor stops operating, while the pressure below the valve is allowed to equilibrate. Upon restarting the refrigeration system, it is therefore easier and more efficient to achieve the high pressure state in the system.

Exemplary embodiments of a compressor with a pressure equalization system consistent with the present invention are illustrated in FIGS. 2 and 3. It is contemplated that pressure equalization system 10 may be located internally within compressor 2, as shown in FIG. 2, or externally as shown in FIGS. 1 and 3. The compressor shown in FIG. 2 is a reciprocating compressor, although the pressure equalization system may be used with any compressor, including, for example, a rotary, screw, or scroll compressor.

As illustrated in FIGS. 2 and 3, compressor outlet 20 is in communication with a housing 24 of pressure equalization system 10, which has a housing inlet 34 and a housing outlet 36. In FIG. 2, housing 24 is located internally within compressor 2, and housing outlet 36 connects to compressor outlet 20. The present invention contemplates, however, that housing 24 in FIG. 3 may be positioned externally to compressor 2, such that housing inlet 34 connects to compressor outlet 20. Among other variations, it also has been contemplated that housing inlet 34 could be connected to a cylinder head and housing outlet 36 could be connected to compressor outlet 20.

In the embodiments shown in FIGS. 2 and 3, housing 24 is a container or a muffler. Housing 24 also could be a cylinder or any other closed chamber, as described in more detail with respect to FIGS. 8–10. Whether housing 24 is internal or external to compressor 2, the pressure equalization system 10 maintains the fluid at a high pressure vapor state on the high pressure side towards housing outlet 36 while allowing the fluid towards compressor inlet 16 to equilibrate with the fluid at a low pressure vapor state.

Various embodiments of pressure equalization system 10 are depicted in FIGS. 4–10. In each of these embodiments, it is assumed that housing 24 is in communication with compressor 2 as previously described.

Figure 4:
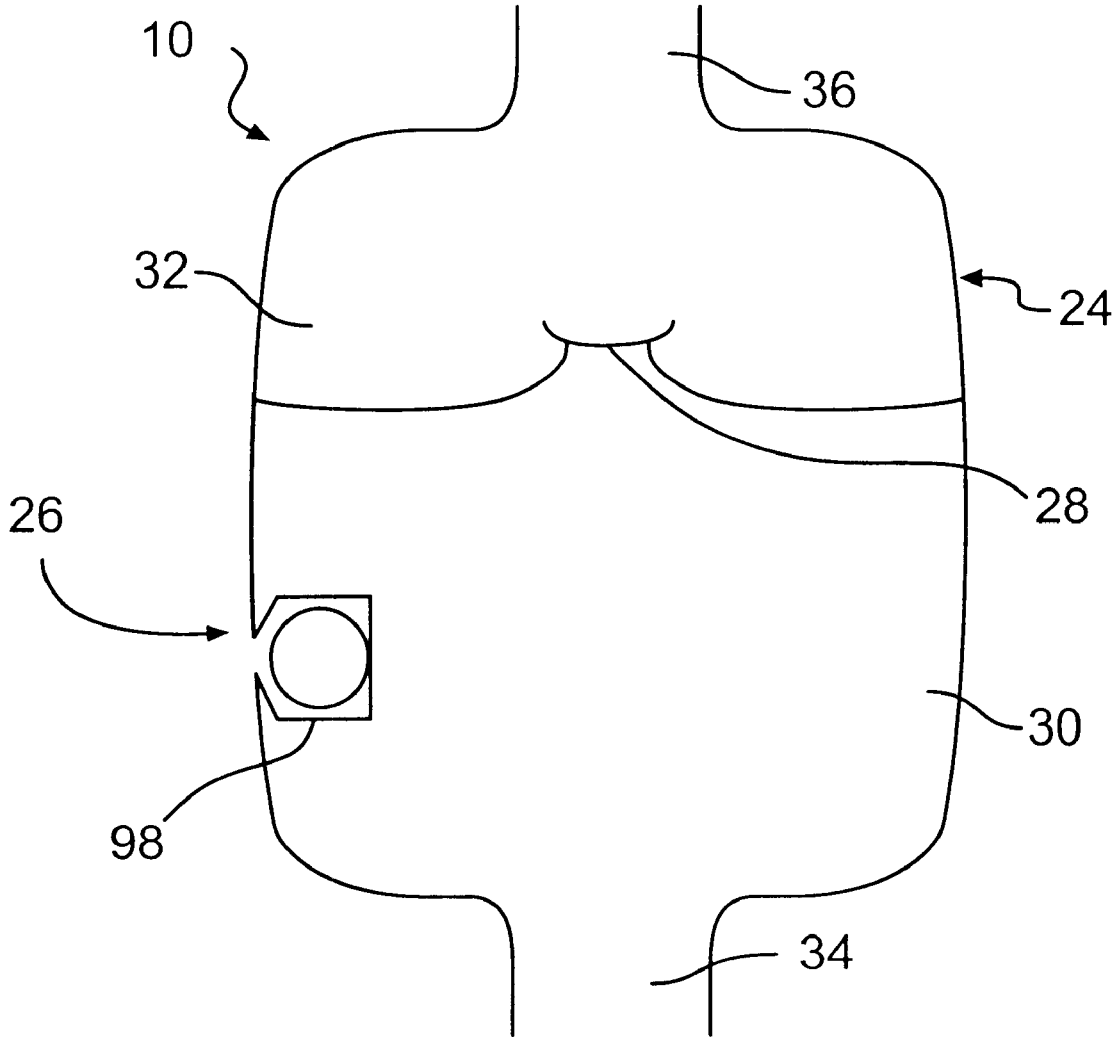
FIG. 4 is a cross-sectional view of a pressure equalization system, including a housing, two valves, and a bleed port, in accordance with an embodiment of the present invention.

In a basic embodiment of pressure equalization system 10, shown in FIG. 4, housing 24 has a bleed port 26 and at least one valve 28. Valve 28 divides housing 24 into a first portion 30 and a second portion 32. First portion 30 of housing 24 occupies a space between housing inlet 34 and valve 28, while second portion 32 of housing 24 occupies a space between valve 28 and housing outlet 36. Valve 28 is operably disposed in housing 24 and may be opened or closed. When compressor 2 is on, valve 28 is open and allows the fluid compressed at a high pressure vapor state to flow from first portion 30 of housing 24 to second portion 32 of housing 34. When compressor 2 stops operating, valve 28 closes, preventing backflow of the fluid at a high pressure vapor state into first portion of housing 24. Bleed port 26, located in first portion 30 of housing 24, connects first portion 30 of housing 24 to low pressure side 72 of compressor 2 (FIG. 1), such as to compressor inlet 16, allowing the pressure of the fluid, which is at a high pressure vapor state when the compressor initially is turned off, to equilibrate with the fluid on the low side of compressor 2, which is at a low pressure vapor state. Bleed port 26 is connected to a low pressure side of compressor 2 in a sealed manner, for example, through a pipe, tube, or other flow channel, so that the fluid stays within the system and does not leak into the atmosphere.

Figure 11:
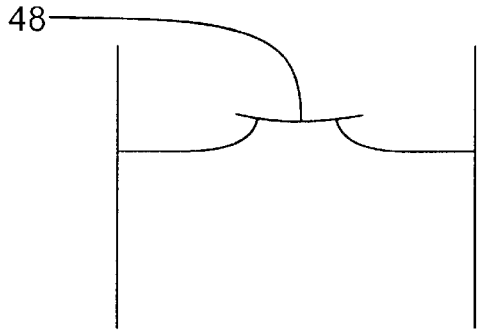
FIG. 11 is a cross sectional view of a magnetic check valve in accordance with an embodiment of the present invention.
Figure 12:
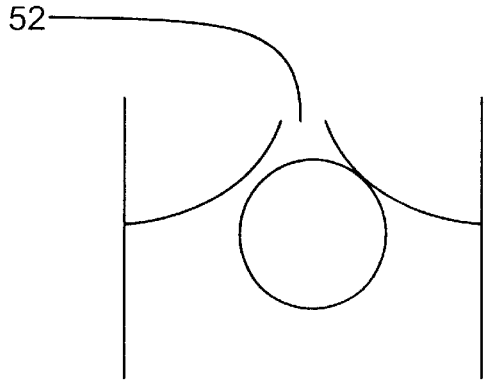
FIG. 12 is a cross sectional view of a ball check valve in accordance with another embodiment of the present invention.
Figure 13:
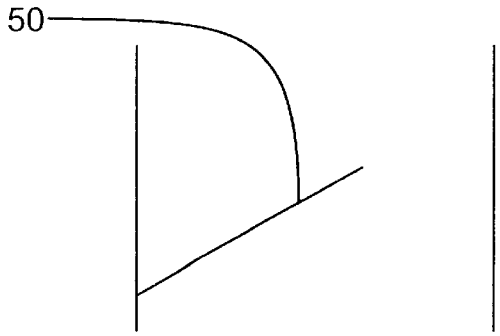
FIG. 13 is a cross sectional view of a flapper check valve in accordance with another embodiment of the present invention.

It is contemplated that valve 28 of pressure equalization system 10 may be one or more of a variety of valve types. Some typical valves are illustrated in FIGS. 11–13. One embodiment, illustrated in FIG. 11, is a magnetic check valve 48. Another embodiment, illustrated in FIG. 12, is a ball check valve 52. Yet another embodiment, illustrated in FIG. 13, is a flapper check valve 50. Any type of one-way valve, including but not limited to these valves, can be applied to the present invention.

Figure 8:
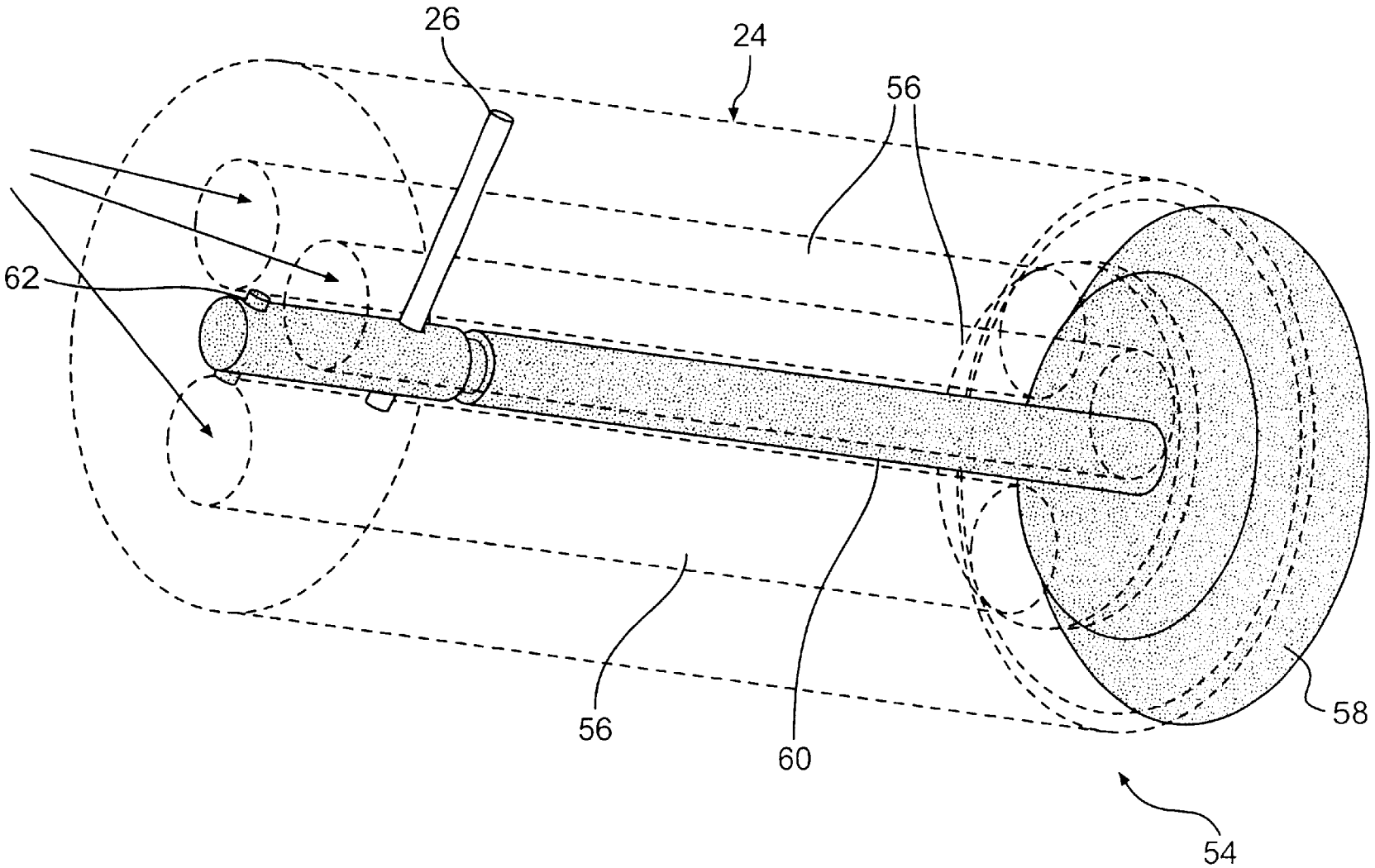
FIG. 8 is a perspective view of a cylinder valve in accordance with an embodiment of the present invention.
Figure 9:
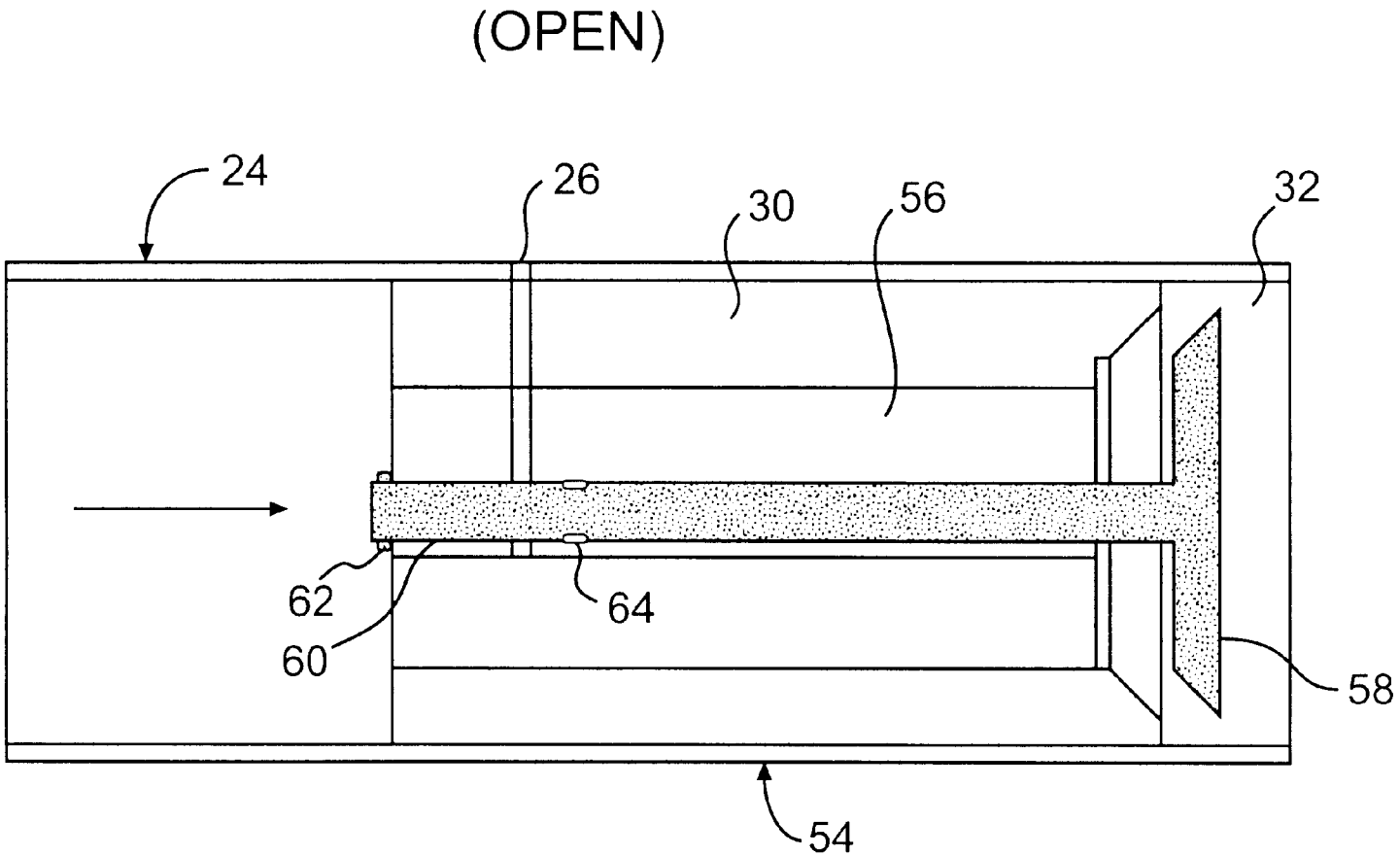
FIG. 9 is a section through the piece of the cylinder valve depicted in FIG. 8 in an open position.
Figure 10:
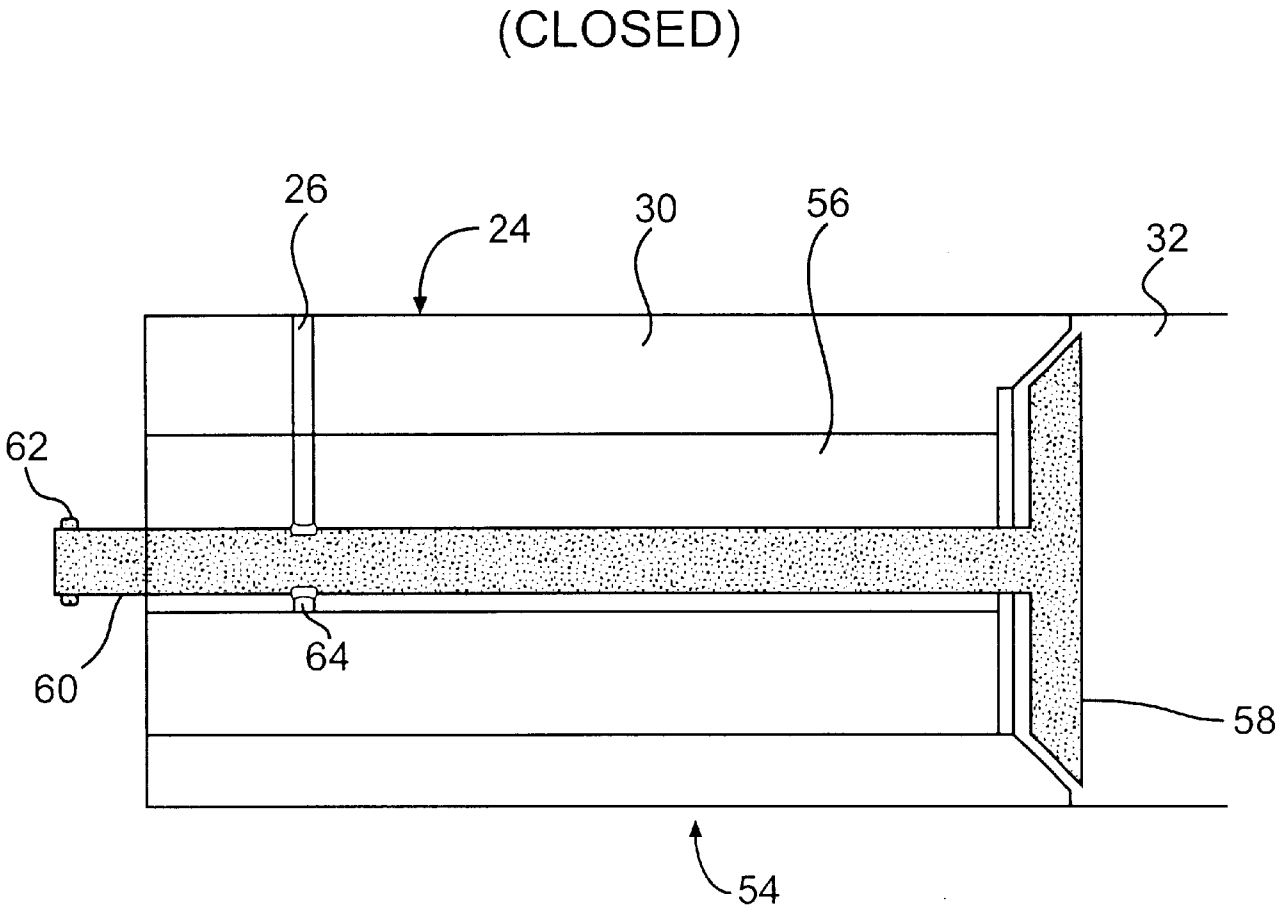
FIG. 10 is a section through the piece of the cylinder valve depicted in FIG. 8 in a closed position.

In an embodiment illustrated in FIGS. 8–10, pressure equalization system 10 comprises housing 24 having a cylinder check valve 54, and preferably bleed port 26 is of an aperture 64 type. In such an embodiment, housing 24 defines a cylinder that includes a plurality of channels 56 for conducting the fluid. It is contemplated, however, that cylindrical housing 24 may have as few as one channel 56. First portion 30 of cylindrical housing 24 is substantially solid aside from channels 56, while second portion 32 of cylindrical housing 24 is open. Valve 28 disposed within cylindrical housing 24 has a valve stem 60 attached to an end portion such as a poppet 58.

Poppet 58 is located in second portion 32 of housing 24. It is contemplated that poppet 58 has an area equal to the internal area of cylindrical housing 24, although any configuration of housing 24 and poppet 58 that prohibits the fluid from leaking from first portion 30 of housing 24, through valve 28, to housing outlet 36, is acceptable.

Meanwhile, valve stem 60 extends from poppet 58 through first portion 30 of housing 24 and towards inlet 34 of housing 24. Valve stem 60 may have an overtravel stopper 62 beyond inlet 34 of housing 24 that comes in contact with the substantially solid first portion 30 of housing 24 when compressor 2 is operating. Although overtravel stopper 62 is shown in the embodiment illustrated in FIGS. 8–10, any device that prevents poppet 58 and valve stem 60 from being pushed through housing 24 by the fluid is acceptable.

When compressor 2 is operating, the fluid at a high pressure vapor state travels into inlet 34 of housing 24 and into channels 56, forcing cylinder valve 54 to open. As shown in FIG. 9, because the fluid forces poppet 58 into second portion 32 of housing 24, the fluid passes through the opening created when poppet 58 is forced open and toward housing outlet 38. Overtravel stopper 62 prevents poppet 58 and valve stem 60 from being forced too far into or beyond second portion 36 of housing 24. As shown in FIG. 10, when compressor 2 stops operating, the fluid stops flowing into housing inlet 34 and into channels 56, and as a result poppet 58 is no longer forced open by the fluid. Poppet 58 therefore closes, preventing the fluid contained in second portion 32 of housing 24 from flowing back towards housing inlet 34. The fluid on high pressure side 70 of compressor 2 therefore remains at a high pressure vapor state, thus high pressure side 70 of compressor 2 remains high (FIG. 1).

In accordance with the present invention, a bleed port is provided to equalize pressure upon startup of a compressor. In an embodiment shown in FIGS. 8–10, when compressor 2 stops operating, the high pressure vapor state fluid in channels 56 in first portion 30 of housing 24 is allowed to equilibrate with the fluid at a low pressure vapor state, thus low pressure side 72 of compressor 2 remains low (FIG. 1), leading to the aforementioned benefits upon restarting compressor 2. The equilibration in this preferred embodiment is due to bleed port 26, as shown in FIGS. 8–10 and described more fully below.

It is also contemplated that bleed port 26 of pressure equalization system 10 includes a variety of forms, provided bleed port 26 allows the fluid contained in first portion 30 of housing 24 at a high pressure vapor state to equalize with the fluid at a low pressure vapor state on low pressure side 72 of compressor 2. Additionally, bleed port 26 is configured so that little to no fluid leaks through to low pressure side 72 of compressor 2 when refrigeration system 74 is on but fluid leaks through to low pressure side 72 of compressor 2 when refrigeration system 74 is turned off (FIG. 1).

For example, bleed port 26 may be a simple aperture or hole in first portion of housing 24. As illustrated in FIG. 2, when housing 24 is located internally within compressor 2, bleed port 26 may be a hole or aperture 64 between housing 24 and compressor inlet 16. In this embodiment, bleed port 26 is small enough to prevent a significant amount of fluid from flowing back to compressor inlet 16 when the compressor is operating, but large enough to allow the pressure of the fluid to reach a state of equilibrium with low pressure side 72 of compressor 2 over a period of time when the compressor stops operating.

Meanwhile, when housing 24 is external to compressor 2, as shown in FIG. 3, a connector 42, such as a capillary or other tube or hypodermic needle, connects first portion 30 of housing 24 to low pressure side 72 of compressor 2, such as to compressor inlet 16, in order to equalize fluid pressure. Again, bleed port 26, including aperture 64 leading to connector 42, is small enough to prevent a significant amount of fluid from flowing back to compressor inlet 16 when the compressor is operating, but large enough to allow the pressure of the fluid to reach a state of equilibrium with low pressure side 72 of compressor 2 over a period of time when the compressor stops operating.

Figure 6:
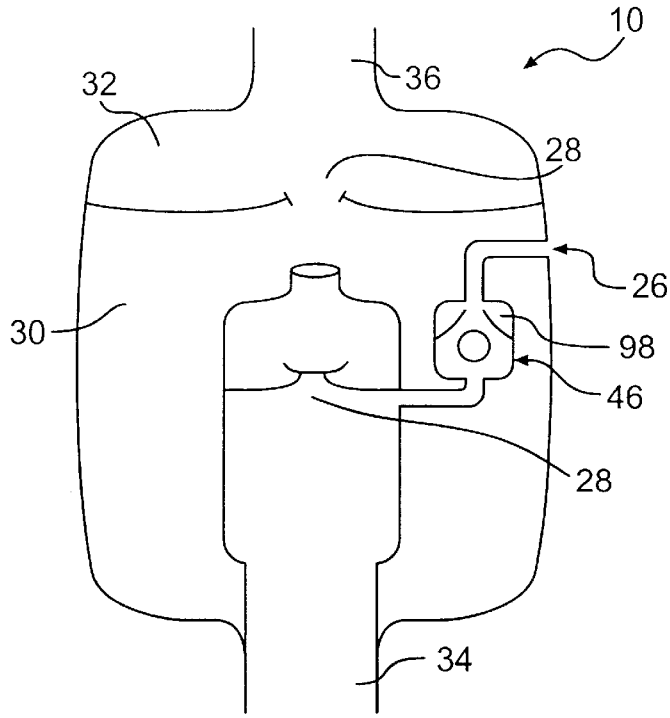
FIG. 6 is a cross-sectional view of a pressure equalization system, including a housing, several valves, and an internal subhousing with a bleed port, in accordance with another embodiment of the present invention.
Figure 7:
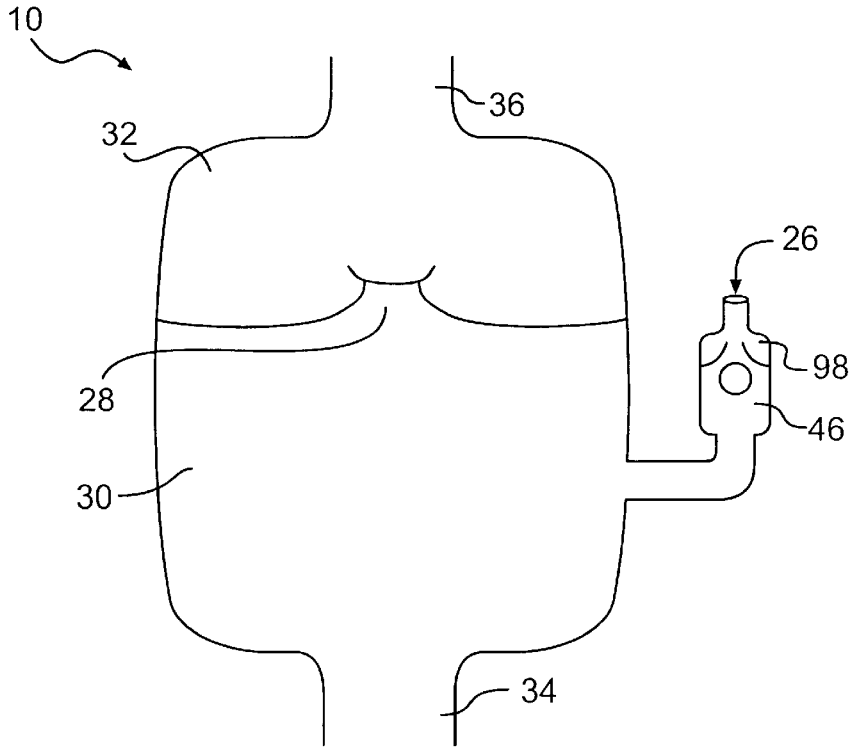
FIG. 7 is a cross-sectional view of a pressure equalization system, including a housing, two valves, and an external subhousing with a bleed port, in accordance with another embodiment of the present invention.

Additionally, as illustrated in FIGS. 4, 6, and 7, bleed port 26 may be a valve 98 of any type described above with respect to valve 28, including but not limited to magnetic check valve 48, flapper check valve 50, ball check valve 52, or a combination of any such valve and connector 42. The tolerance of valve 98 allows valve 98 to open under a lower fluid pressure, letting the fluid leak through valve 98 when compressor 2 stops operating to achieve a state of equilibrium with low pressure side 72 of compressor 2, but the tolerance allows valve 98 to close under a higher fluid pressure, preventing fluid from passing through valve 98 when compressor 2 is operating. Valve 98 therefore has a tolerance over a range of pounds per square inch that meets this requirement for the particular refrigeration or HVAC system 74.

In a preferred embodiment of pressure equalization system 10, bleed port 26 is designed so that it will allow the fluid to bleed from high pressure side 70 to low pressure side 72 only when compressor 2 is not operating (FIG. 1). One embodiment of such a system is illustrated in FIGS. 8–10. In this embodiment, a cylinder valve 54 is formed by housing 24, poppet 58, and valve stem 60. As shown in FIGS. 8–10, depicting cylinder valve 54, valve stem 60 has an aperture 64. First portion 30 of housing 24, which is substantially solid aside from channels 56, has bleed port 26 connecting all channels 56. There may be one or more such channels 56. It is contemplated that bleed port 26 is in communication with low pressure side 72 of compressor 2, as previously discussed with respect to apertures and connectors such as tubes in embodiments shown in FIGS. 2 and 3.

In the preferred embodiment, pressure equalization system 10 is highly efficient because bleed port 26 allows equilibration of the fluid in first portion 30 of housing 24 when compressor 2 stops operating but prevents any of the fluid from leaking from first portion 30 of housing 24 towards low pressure side 72 of compressor 2 when compressor 2 is operating. When compressor 2 is operating, the fluid forces poppet 58 open, which is connected to valve stem 60. Thus, aperture 64 in valve stem 60 misaligns with bleed port 26, thereby preventing any of the fluid at a high pressure vapor state from leaking from channels 56 out of bleed port 26. This "open" position is shown in FIG. 9. When compressor 2 stops operating, poppet 58 closes and connected valve stem 60 therefore also moves, causing aperture 64 and bleed port 26 to align, as shown in FIG. 10. Because poppet 58 closes, the fluid at a high pressure vapor state in second portion 32 of housing 24 is held at high pressure, as previously described. Meanwhile, due to the valve stem/aperture/bleed port configuration shown in FIGS. 8–10, the fluid at a high pressure vapor state is allowed to leak from channels 56 in first portion 30 of housing 24, though aperture 64, and into bleed port 26. Equilibration of the fluid in first portion 30 of housing 24 therefore is achieved via bleed port 26 in pressure equalization system 10, as previously described with respect to FIGS. 2 and 3.

The embodiments shown in FIGS. 1–10 are only representative of additional potential configurations of pressure equalization systems 10 and in no way are intended to limit the present invention.

Figure 5A:
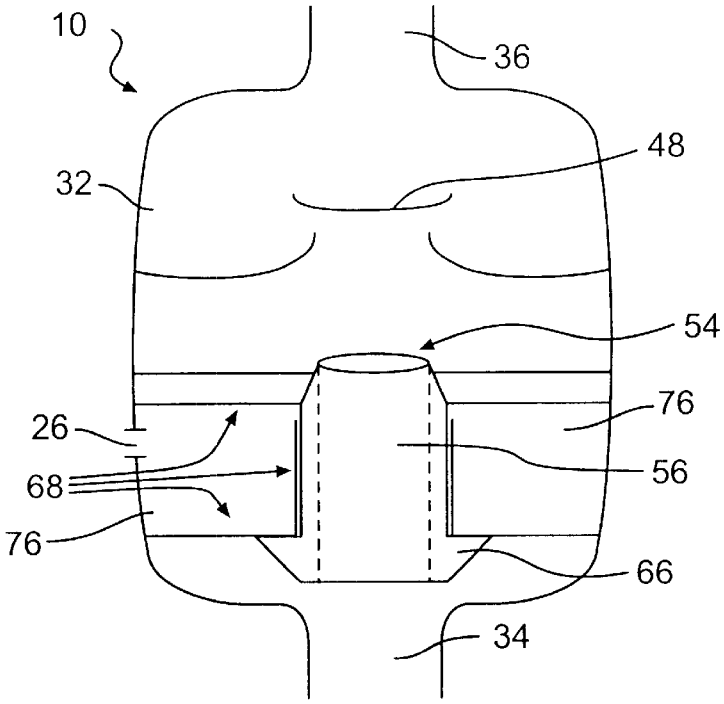
In FIG. 5*a*, the bleed port is in a closed position.
Figure 5B:
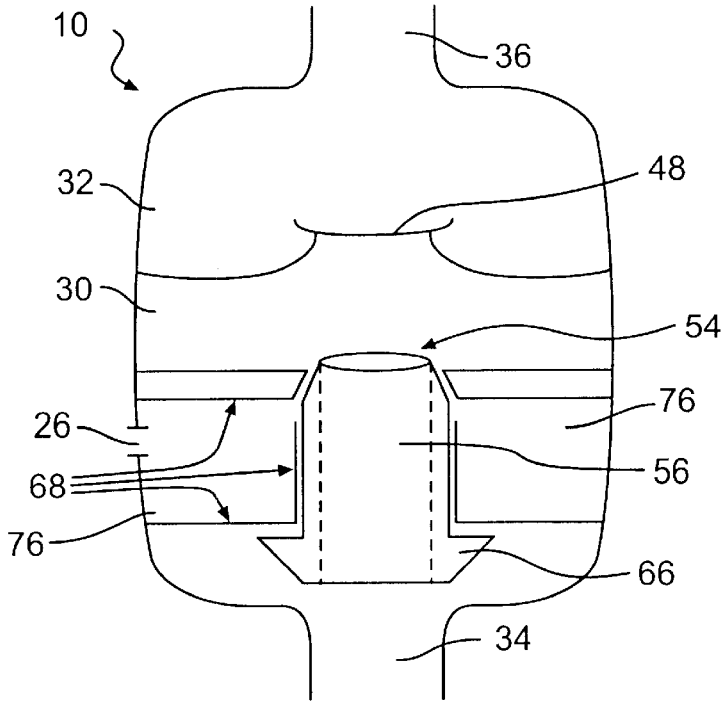
in FIG. 5*b*, the bleed port is in an open position.

FIGS. 5*a* and 5*b* illustrate an embodiment of pressure equalization system 10 internal or external to compressor 2. Housing 24 contains a valve, such as a magnetic check valve 48, separating first portion 30 of housing 24 from second portion 32. First portion 30 further contains a second valve, such as a cylinder-type check valve 54, operably disposed in a check valve guide 68. Cylinder check valve guide 68 defines low pressure chambers 76 on either side. Cylinder check valve 54 has a lip 66 on the end facing inlet 34 of housing 24 to prevent cylinder check valve 54 from passing through check valve guide 54 when compressor 2 is operating. Cylinder check valve 54 also has a channel 56 through which the fluid passes towards outlet 36 of housing 24 when compressor 2 is operating. Bleed port 26 is an aperture located in housing 24 in an area encompassed by low pressure chamber 76. Pressure equalization system 10, as shown in FIGS. 5*a* and 5*b*, therefore maintains the fluid at a high pressure vapor state in second portion 32 of housing 24 while allowing the fluid in first portion 30 of housing 24 to equilibrate with the fluid at a low pressure vapor state.

As shown in FIG. 5*a*, when compressor 2 is operating, the fluid flows at a high pressure state into first portion 30 of housing 24, through first channel 56 of cylinder check valve 54, and through magnetic check valve 48 into second portion 32 of housing 24. Because of the fluid pressure, cylinder check valve 54 abuts cylinder check valve guide 68, closing bleed port 26. When compressor 2 stops operating, as shown in FIG. 5*b*, magnetic check valve 48 closes and the fluid remains at a high pressure vapor state in second portion 32 of housing 24. The fluid in first portion 30 of housing 24 is also at a high pressure vapor state but begins to leak into low pressure chambers 76 and through bleed port 26. When compressor 2 stops operating, the fluid pressure against the bottom of cylinder check valve 54 decreases and cylinder check valve 54 no longer abuts against the cylinder check valve guide 68.

FIGS. 6 and 7 illustrate embodiments of the present invention where bleed port 26 is a subhousing 26 housing a valve 98. In FIG. 6, subhousing 46 for valve 98 is located internally within first portion 30 of housing 24, while in FIG. 7 subhousing 46 for valve 98 is external to but in communication with first portion 30 of housing 24. The pressure equalization systems depicted in FIGS. 6 and 7 generally operate in the same manner as those previously described.

The method for equalizing pressure to allow compressor 2 to start under high pressure loading using pressure equalization system 10 will now be described in detail with reference to FIG. 3. When compressor 2 is turned on, the fluid enters compressor 2 at a low pressure vapor state through compressor inlet 16 and into compression chamber 80. As piston 78 compresses the fluid, valve system 84 prevents the fluid from exiting compressor 2 through inlet 16, as previously described. Valve 92 opens under the increasing pressure, allowing the fluid, now at a high pressure vapor state, to discharge through compressor outlet 20 and into inlet 34 of housing 24. The fluid then passes from first portion 30 of housing 24 and through valve 28 into second portion 32 of housing 24. Valve 28 opens due to the pressurized flow of the fluid created by piston 78. The fluid then exits housing 24 through housing outlet 36 on its way to condenser 8, as shown schematically in FIG. 1.

When compressor 2 is turned off, valves 28 and 92 close as piston 78 no longer is compressing and forcing the fluid through compressor outlet 20. Due to the lower fluid pressure, expansion valve 6 also closes. The fluid located above valve 28 in second portion 32 of housing 24 therefore remains at a high pressure vapor state and maintains the high pressure side 70, as shown in FIG. 1. Meanwhile, the fluid at a high pressure vapor state located in first portion 30 of housing 24 bleeds through bleed port 26 back toward compressor inlet 16 and equilibrates with the fluid at a low pressure vapor state in compressor inlet 16.

Upon restarting compressor 2, high pressure side 72, as shown in FIG. 1, has remained high due to the high pressure state of the fluid above valve 28, creating a high pressure load. Meanwhile, the fluid below valve 28 is at a low pressure state following the equilibration process. As a result, when piston 78 begins to compress the fluid upon restarting compressor 2, the fluid below valve 28 is at a low pressure, making it easier for piston 78 to perform compression. At the same time, a high pressure state has been maintained above valve 28, thus the compression cycle is not starting from ground zero again and less work is needed to achieve the pressure just prior to when the compressor stopped operating. Thus the pressure equalization method and system increases the efficiency of the compressor and the climate control system of which it is a component.

It will be apparent to those skilled in the art that various modifications and variations can be made in the pressure equalization method and system for starting a compressor under high pressure loading without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A pressure equalization system for a compressor having a compressor inlet for receiving a fluid at a first pressure and a compressor outlet for discharging the fluid at a second pressure, the compressor operable to compress a fluid from the first pressure to the second pressure, the system comprising:

a valve proximate to and in fluid communication with the compressor outlet and having an open and a closed position, the valve movable to the open position when the compressor is operating to allow the fluid at the second pressure to flow through the valve, and the valve movable to the closed position when the compressor stops operating to prevent backflow of the fluid at the second pressure through the valve toward the compressor inlet; and a bleed port upstream of the valve and in fluid communication with the compressor inlet to equalize the pressure of the fluid contained in the compressor when the compressor stops operating;

the pressure equalization system further comprising a housing in communication with the compressor outlet that houses the bleed port and the valve, wherein the valve divides the housing into at least a first portion and a second portion, the first portion of the housing encompassing a space between a housing inlet and the valve and the second portion of the housing encompassing a space between the valve and a housing outlet, and wherein the compressor includes an external shell and the housing of the pressure equalization system is disposed internally within the shell.

2. The pressure equalization system of claim-k wherein the compressor includes a compression chamber and the housing inlet is connected with the compression chamber and the housing outlet is connected with the compressor outlet.

3. The pressure equalization system of claim 1, wherein the housing is a muffler.

4. A pressure equalization system for a compressor having a compressor inlet for receiving a fluid at a first pressure and a compressor outlet for discharging the fluid at a second pressure, the compressor operable to compress a fluid from the first pressure to the second pressure, the system comprising:

a housing in communication with the compressor outlet that houses a bleed port and a valve, wherein the valve divides the housing into at least a first portion and a second portion, the first portion of the housing encompassing a space between a housing inlet and the valve and the second portion of the housing encompassing a space between the valve and a housing outlet;

the valve proximate to and in fluid communication with the compressor outlet and having an open and a closed position, the valve movable to the open position when the compressor is operating to allow the fluid at the second pressure to flow through the valve, and the valve movable to the closed position when the compressor stops operating to prevent backflow of the fluid at the second pressure through the valve toward the compressor inlet, and wherein the valve is a check valve having a portion extending into the first portion of the housing; and the bleed port upstream of the valve and in fluid communication with the compressor inlet to equalize the pressure of the fluid contained in the compressor when the compressor stops operating, wherein the bleed port includes a first port formed in the first portion of the housing and a second port formed in the portion of the check valve extending into the first portion of the housing, the first port and the second port aligning when the compressor stops operating and misaligning when the compressor is operating, whereby fluid flows through the bleed port only when the compressor stops operating.

5. A pressure equalization system for a compressor having a compressor inlet for receiving a fluid at a first pressure and a compressor outlet for discharging the fluid at a second pressure, the compressor operable to compress a fluid from the first pressure to the second pressure, the system comprising:

a valve proximate to and in fluid communication with the compressor outlet and having an open and a closed position, the valve movable to the open position when the compressor is operating to allow the fluid at the second pressure to flow through the valve, and the valve movable to the closed position when the compressor stops operating to prevent backflow of the fluid at the second pressure through the valve toward the compressor inlet;

a bleed port upstream of the valve and in fluid communication with the compressor inlet to equalize the pressure of the fluid contained in the compressor when the compressor stops operating;

a housing in communication with the compressor outlet that houses the bleed port and the valve, wherein the valve divides the housing into at least a first portion and a second portion, the first portion of the housing encompassing a space between a housing inlet and the valve and the second portion of the housing encompassing a space between the valve and a housing outlet, wherein the valve is a magnetic check valve, the first portion of the housing having a second valve operably disposed within a check valve guide, and wherein the second valve is a cylinder check valve having a lip on an end of the second valve facing the compressor inlet to prevent the second valve from passing through the check valve guide when the compressor is operating and having a channel through which the fluid passes towards the housing outlet when the compressor is operating and through which the fluid leaks towards the housing inlet when the compressor stops operating.

6. A pressure equalization system for a compressor having a high pressure side and a low pressure side, a compressor inlet for receiving a fluid at a first pressure and a compressor outlet for discharging the fluid at a second pressure, the compressor operable to compress the fluid from the first pressure to the second pressure, the system comprising:

a container disposed internally within an external shell of the compressor, the container in fluid communication with the compressor and having at least one valve operably disposed within the container and a bleed port, wherein the container is divided into at least a first portion from an inlet to the at least one valve and a second portion from the at least one valve to an outlet;

the at least one valve operably configured to allow the compressed fluid to flow therethrough to the second portion of the container when the compressor is operating, and to prevent the compressed fluid in the second portion of the container from flowing back through the at least one valve to the first portion of the container when the compressor stops operating; and the bleed port connecting the first portion of the container and the low pressure side of the compressor and operably configured to bleed the compressed fluid from the first portion of the container to the low pressure side of the compressor when the compressor stops operating.

7. The pressure equalization system of claim 6, wherein the compressor includes a compression chamber and the container inlet is connected with the compression chamber and the container outlet is connected with the compressor outlet.

8. A pressure equalization system for a compressor having a high pressure side and a low pressure side, a compressor inlet for receiving a fluid at a first pressure and a compressor outlet for discharging the fluid at a second pressure, the compressor operable to compress the fluid from the first pressure to the second pressure, the system comprising:

a muffler in fluid communication with the compressor and having at least one valve operably disposed within the muffler and a bleed port, wherein the muffler is divided into at least a first portion from an inlet to the at least one valve and a second portion from the at least one valve to an outlet;

the at least one valve operably configured to allow the compressed fluid to flow therethrough to the second portion of the muffler when the compressor is operating, and to prevent the compressed fluid in the second portion of the muffler from flowing back through the at least one valve to the first portion of the muffler when the compressor stops operating; and the bleed port connecting the first portion of the muffler and the low pressure side of the compressor and operably configured to bleed the compressed fluid from the first portion of the muffler to the low pressure side of the compressor when the compressor stops operating.

9. A pressure equalization system for a compressor having a high pressure side and a low pressure side, a compressor inlet for receiving a fluid at a first pressure and a compressor outlet for discharging the fluid at a second pressure, the compressor operable to compress the fluid from the first pressure to the second pressure, the system comprising:

a container in fluid communication with the compressor and having at least one valve operably disposed within the container and a bleed port, wherein the container is divided into at least a first portion from an inlet to the at least one valve and a second portion from the at least one valve to an outlet;

the at least one valve operably configured to allow the compressed fluid to flow therethrough to the second portion of the container when the compressor is operating, and to prevent the compressed fluid in the second portion of the container from flowing back through the at least one valve to the first portion of the container when the compressor stops operating, and wherein the at least one valve is a check valve having a portion extending into the first portion of the container; and the bleed port connecting the first portion of the container and the low pressure side of the compressor and operably configured to bleed the compressed fluid from the first portion of the container to the low pressure side of the compressor when the compressor stops operating, wherein the bleed port includes a first port formed in the first portion of the container and a second port formed in the portion of the check valve extending into the first portion of the container, the first port and the second port aligning when the compressor stops operating and misaligning when the compressor is operating, whereby fluid flows through the bleed port only when the compressor stops operating.

10. A pressure equalization system for a compressor having a high pressure side and a low pressure side, a compressor inlet for receiving a fluid at a first pressure and a compressor outlet for discharging the fluid at a second pressure, the compressor operable to compress the fluid from the first pressure to the second pressure, the system comprising:

a container in fluid communication with the compressor and having at least one valve operably disposed within the container and a bleed port, wherein the container is divided into at least a first portion from an inlet to the at least one valve and a second portion from the at least one valve to an outlet;

the at least one valve operably configured to allow the compressed fluid to flow therethrough to the second portion of the container when the compressor is operating, and to prevent the compressed fluid in the second portion of the container from flowing back through the at least one valve to the first portion of the container when the compressor stops operating, and wherein one of the at least one valves is a magnetic check valve, the first portion of the container having a second valve operably disposed within a check valve guide, and wherein the second valve is a cylinder check valve having a lip on an end of the second valve facing the low side of the compressor to prevent the second valve from passing through the check valve guide when the compressor is operating and having a channel through which the fluid passes towards the container outlet when the compressor is operating and through which the fluid leaks towards the container inlet when the compressor stops operating; and the bleed port connecting the first portion of the container and the low pressure side of the compressor and operably configured to bleed the compressed fluid from the first portion of the container to the low pressure side of the compressor when the compressor stops operating.

11. A climate control system with a fluid having a liquid state and a vapor state, the liquid state having a low pressure and a high pressure state, comprising:

a compressor, having a low pressure side and a high pressure side, the compressor operable to draw in the fluid at a low pressure vapor state from the low pressure side at a compressor inlet, compress the vapor state, and discharge the fluid at a high pressure vapor state to the high pressure side at a compressor outlet;

a housing in communication with the compressor outlet that houses a bleed port and a valve, wherein the valve divides the housing into at least a first portion and a second portion, the first portion of the housing encompassing a space between a housing inlet and the valve and the second portion of the housing encompassing a space between the valve and a housing outlet, and wherein the housing is disposed internally within an external shell of the compressor;

the valve proximate to and in fluid communication with the compressor outlet and having an open and a closed position, the valve movable to the open position when the compressor is operating to allow the fluid at the second pressure to flow through the valve, and the valve movable to the closed position when the compressor stops operating to prevent backflow of the fluid at the second pressure through the valve toward the compressor inlet; and the bleed port upstream of the valve and in fluid communication with the compressor inlet to equalize the pressure of the fluid contained in the compressor when the compressor stops operating; and a condenser in communication with the compressor, the condenser operable to extract heat from the fluid to convert the fluid from the high pressure vapor state to a high pressure liquid state.

12. The climate control system of claim 11, wherein the compressor includes a compression chamber and the housing inlet is connected with the compression chamber and the housing outlet is connected to the compressor outlet.

13. A climate control system with a fluid having a liquid state and a vapor state, the liquid state having a low pressure and a high pressure state, comprising:

a compressor, having a low pressure side and a high pressure side, the compressor operable to draw in the fluid at a low pressure vapor state from the low pressure side at a compressor inlet, compress the vapor state, and discharge the fluid at a high pressure vapor state to the high pressure side at a compressor outlet;

a muffler in communication with the compressor outlet that houses a bleed port and a valve, wherein the valve divides the muffler into at least a first portion and a second portion, the first portion of the muffler encompassing a space between a housing inlet and the valve and the second portion of the muffler encompassing a space between the valve and a housing outlet;

the valve proximate to and in fluid communication with the compressor outlet and having an open and a closed position, the valve movable to the open position when the compressor is operating to allow the fluid at the second pressure to flow through the valve, and the valve movable to the closed position when the compressor stops operating to prevent backflow of the fluid at the second pressure through the valve toward the compressor inlet; and the bleed port upstream of the valve and in fluid communication with the compressor inlet to equalize the pressure of the fluid contained in the compressor when the compressor stops operating; and a condenser in communication with the compressor, the condenser operable to extract heat from the fluid to convert the fluid from the high pressure vapor state to a high pressure liquid state.

14. A climate control system with a fluid having a liquid state and a vapor state, the liquid state having a low pressure and a high pressure state, comprising:

a compressor, having a low pressure side and a high pressure side, the compressor operable to draw in the fluid at a low pressure vapor state from the low pressure side at a compressor inlet, compress the vapor state, and discharge the fluid at a high pressure vapor state to the high pressure side at a compressor outlet;

a housing in communication with the compressor outlet that houses a bleed port and a valve, wherein the valve divides the housing into at least a first portion and a second portion, the first portion of the housing encompassing a space between a housing inlet and the valve and the second portion of the housing encompassing a space between the valve and a housing outlet;

the valve proximate to and in fluid communication with the compressor outlet and having an open and a closed position, the valve movable to the open position when the compressor is operating to allow the fluid at the second pressure to flow through the valve, and the valve movable to the closed position when the compressor stops operating to prevent backflow of the fluid at the second pressure through the valve toward the compressor inlet, wherein the valve is a check valve having a portion extending into the first portion of the housing; and the bleed port upstream of the valve and in fluid communication with the compressor inlet to equalize the pressure of the fluid contained in the compressor when the compressor stops operating, wherein the bleed port includes a first port formed in the first portion of the housing and a second port formed in the portion of the check valve extending into the first portion of the housing, the first port and the second port aligning when the compressor stops operating and misaligning when the compressor is operating, whereby fluid flows through the bleed port only when the compressor stops operating; and a condenser in communication with the compressor, the condenser operable to extract heat from the fluid to convert the fluid from the high pressure vapor state to a high pressure liquid state.

15. A climate control system with a fluid having a liquid state and a vapor state, the liquid state having a low pressure and a high pressure state, comprising:

a compressor, having a low pressure side and a high pressure side, the compressor operable to draw in the fluid at a low pressure vapor state from the low pressure side at a compressor inlet, compress the vapor state, and discharge the fluid at a high pressure vapor state to the high pressure side at a compressor outlet;

a housing in communication with the compressor outlet that houses a bleed port and a valve, wherein the valve divides the housing into at least a first portion and a second portion, the first portion of the housing encompassing a space between a housing inlet and the valve and the second portion of the housing encompassing a space between the valve and a housing outlet;

the valve proximate to and in fluid communication with the compressor outlet and having an open and a closed position, the valve movable to the open position when the compressor is operating to allow the fluid at the second pressure to flow through the valve, and the valve movable to the closed position when the compressor stops operating to prevent backflow of the fluid at the second pressure through the valve toward the compressor inlet, wherein the valve is a magnetic check valve, the first portion of the housing having a second valve operably disposed within a check valve guide, and wherein the second valve is a cylinder check valve having a lip on an end of the second valve facing the compressor inlet to prevent the second valve from passing through the check valve guide when the compressor is operating; and the bleed port upstream of the valve and in fluid communication with the compressor inlet to equalize the pressure of the fluid contained in the compressor when the compressor stops operating; and a condenser in communication with the compressor, the condenser operable to extract heat from the fluid to convert the fluid from the high pressure vapor state to a high pressure liquid state.

* * * * *

UNITED STATES PATENT AND TRADEMARK OFFICE

CERTIFICATE OF CORRECTION

PATENT NO. : 6,584,791 B2
DATED : July 1, 2003
INVENTOR(S) : David T. Monk et al.

It is certified that error appears in the above-identified patent and that said Letters Patent is hereby corrected as shown below:

Column 10,
Line 48, "system of claim-k" should read -- system of claim 1 --.

Signed and Sealed this

Eleventh Day of November, 2003

JAMES E. ROGAN
*Director of the United States Patent and Trademark Office*